US008246145B2

(12) United States Patent
Roth et al.

(10) Patent No.: US 8,246,145 B2
(45) Date of Patent: Aug. 21, 2012

(54) APPARATUS FOR CLEARING AN INK DROP STALAGMITE IN AN INKJET PRINTER

(75) Inventors: Teressa L. Roth, Brush Prairie, WA (US); Kok Leong Law, Singapore (SG); Hai-Lung Hung, Jhong (TW); Kieran B. Kelly, Vancouver, WA (US); John J. Cantrell, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 226 days.

(21) Appl. No.: 12/836,269

(22) Filed: Jul. 14, 2010

(65) Prior Publication Data

US 2012/0013679 A1 Jan. 19, 2012

(51) Int. Cl.
*B41J 2/165* (2006.01)

(52) U.S. Cl. ..... 347/35

(58) Field of Classification Search ..... 347/24, 347/29, 34–36

See application file for complete search history.

(56) References Cited

U.S. PATENT DOCUMENTS

| | | | |
|---|---|---|---|
| 6,588,876 | B2 | 7/2003 | Taylor et al. |
| 6,698,864 | B2 | 3/2004 | Therien |
| 6,742,864 | B2 | 6/2004 | Therien et al. |
| 6,799,829 | B2 | 10/2004 | Mah et al. |
| 7,490,932 | B2 | 2/2009 | Joppen |

*Primary Examiner* — Lamson Nguyen

(57) ABSTRACT

An apparatus for use as part of an inkjet printer to clear an ink drop stalagmite in the printer. In one embodiment the apparatus includes a clearing device coupled to an access door of the inkjet printer, wherein upon operation of the access door the clearing device at least partially clears the ink drop stalagmite.

20 Claims, 12 Drawing Sheets

APPARATUS FOR CLEARING AN INK DROP STALAGMITE IN AN INKJET PRINTER

FIELD OF INVENTION

This invention relates to ink drop stalagmite build-up in an inkjet printer, and in particular to systems for clearing the ink drop stalagmite.

BACKGROUND

For a number of reasons, inkjet print heads regularly expel ink into a dedicated area inside the printer called the service station. Expelling the ink repeatedly over a long enough period of time can cause the ink particles to build a tower, or ink drop stalagmite, in the service station. This ink drop stalagmite can eventually grow tall enough to contact the print head and have the undesirable effects of blocking nozzles, contaminating the moving print head, and interfering with the operation of the print head, all of which may degrade the print quality.

DETAILED DESCRIPTION

A clearing device that addresses ink drop stalagmite build-up in an inkjet printer is presented. In an embodiment, a clearing device may be actuated when an access door in an inkjet printer is operated. The operation of the access door may provide the drive power for the clearing device.

The distance from the print head to where an ink drop stalagmite grows in the service station is typically ample enough to expend multiple ink cartridges before the ink drop stalagmite can build up enough to interfere with the print head operation. Accordingly, the ink drop stalagmite build-up may need to be addressed periodically, perhaps when replacing an ink cartridge. Replacement of the expended ink cartridge may begin by operating (e.g., opening, closing, or otherwise moving) the access door. It is this operation of the access door that is used to drive the clearing device. By drawing drive power for the clearing device from the operation of the access door, the clearing device is kept simple without adding to the power load of the printer or increasing system complexity.

The clearing device may be coupled to the access door. Upon operation of the access door, the clearing device may clear away from the print head an ink drop stalagmite deposited within the apparatus near the print head. The clearing device may include a shaft rotatably connected at one end to a moveable portion of the access door's hinge. The shaft may rotate in a first direction when the access door is opened, and may rotate in a second direction when the access door is closed. Coupled to the shaft at an end distal from the door hinge may be a power transfer device that may transfer the rotational force to a lateral force substantially perpendicular to the axis of rotation.

The lateral force from the power transfer device may drive a clearing mechanism from a first position to a second position. Movement of the clearing mechanism may displace the ink drop stalagmite by either repositioning the ink drop stalagmite or by plowing away at least a top portion of the ink drop stalagmite.

Figure 1:
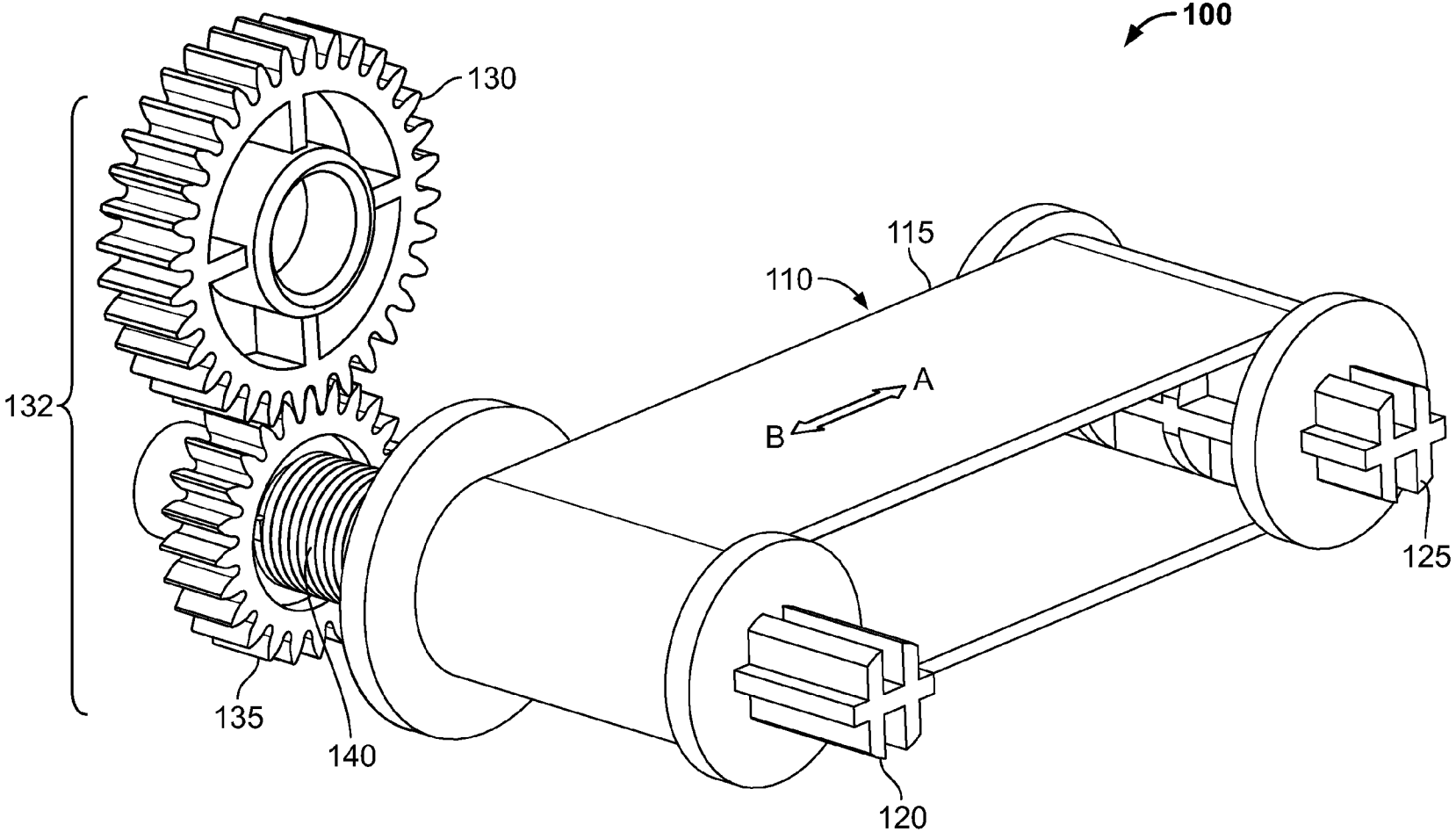
FIG. 1 illustrates a perspective view of an embodiment of the present invention.

FIG. 1 depicts a clearing device 100 as an embodiment of the present invention. Clearing device 100 may include a clearing mechanism 110 that may include belt 115. Belt 115 may be an endless belt formed from a continuous band, or a straight piece with its two ends joined together. Any suitable chemically resistant material can be used to form the belt. Belt 115 may be in contact with, or wrapped around, idle roller 125 and drive roller 120. Idle roller 125 may freely rotate with belt 115, or may be a post over which belt 115 travels. Drive gear 130 can be engagingly coupled to receiving gear 135 to form power gear linkage system 132.

Figure 2:
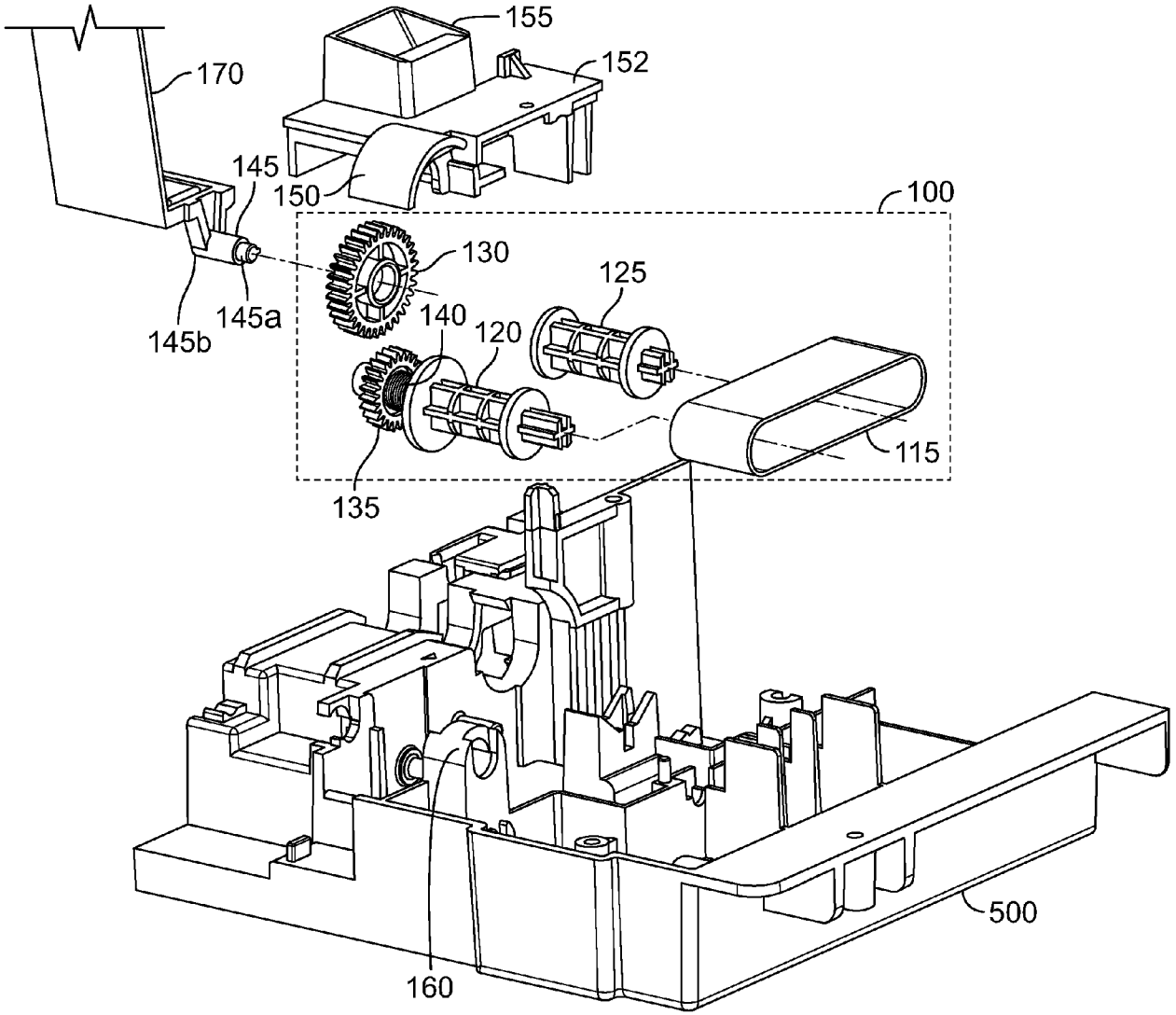
FIG. 2 illustrates an exploded view of the embodiment of FIG. 1 in relation to components of an inkjet printer.

FIG. 2 depicts an exploded view of clearing device 100 in relation to printer base 500, access door 170, and chimney plate 152. Drive gear 130 may be mounted to distal end 145*a* of shaft 145 that rotates when access door 170 is operated (e.g., opened, closed, or otherwise moved). Shaft 145 can be an arm extending from access door 170. Alternative implementations of shaft 145 may be used. For instance, the shaft can be an independent component separate from, but coupled to, the access door. Shaft end 145*b* proximal to the access door can have a cylindrical recess (not shown) that can accommodate a rotating component of the access door hinge. Pinning shaft end 145*b* to the rotating hinge component may ensure that shaft 145 rotates when the access door is operated.

Drive gear 130 may engage receiving gear 135 of power gear linkage system 132. The receiving gear may be positioned on shaft 137 (see FIG. 3). As access door 170 is operated drive gear 130 may rotate causing receiving gear 135 to rotate in an opposite direction. Shaft 137 may be coupled to drive roller 120 through slip clutch 140. Rotation of the drive roller may cause belt 115 to move substantially perpendicular to the axes of rotation of power gear linkage system 132. Thus, power gear linkage system 132 and drive roller 120 may work in conjunction to form a power transfer device that may transfer the rotational power from operating access door 170 into a lateral force substantially perpendicular to the axis of rotation. The lateral force can also be non-perpendicular, or even parallel, to the axis of rotation with the addition of one or more intermediate gears and/or linkage(s).

This lateral force may move clearing mechanism 110 including belt 115 over idle roller 125 in a direction indicated by arrow A (FIG. 1). When access door 170 is operated in an opposite direction, the rotations of drive gear 130 and receiving gear 135 may reverse. Slip clutch 140, shaft 137, and drive roller 120 may disengage and prevent clearing mechanism 110 from reversing, creating one-way belt travel. The lateral force can also be applied to move clearing mechanism 110 in the direction of arrow B. Two-way travel of clearing mechanism 110 may be obtained by coupling receiving gear 135 and drive roller 120 without slip clutch 140.

Belt 115 may be positioned in the service station area of a printer, so that when ink is expelled from the print head it may be deposited on the belt's upper surface. It is on this upper surface that the ink drop stalagmite may grow. However, the incremental, one-way travel of belt 115 may be accomplished with enough distance in direction A so as to move the ink drop stalagmite far enough away from the print head so that the ink drop stalagmite will not affect the operation of the print head. One-way travel of belt 115 in direction B may also accomplish moving the ink drop stalagmite far enough away from the print head so that the ink drop stalagmite will not affect the operation of the print head.

The incremental, one-way travel of belt 115 can be designed—e.g., by adjusting gear sizes and ratios, and/or drive roller and idle roller radii, to be large enough so that the ink drop stalagmite travels over idle roller 125 in one, or more than one, incremental movements. When the ink drop stalagmite travels over idle roller 125, the weight of the ink drop stalagmite may cause it to detach, at least in part, from the belt. Optionally, a scraper (not shown) can be positioned close to belt 115 to dislodge the ink drop stalagmite from the belt. The dislodged ink drop stalagmite may fall to unused space in printer base 500, or may collect in the printer base in any other harmless manner. The two-way travel of belt 115 may allow for belt 115 to reverse direction when the operation of the access door is reversed. By adjusting gear sizes and ratios, and/or drive roller and idle roller radii the two-way travel of belt 115 in a first direction may be set so that the ink drop stalagmite travels over idle roller 125, and optionally beyond a scraper, to dislodge the ink drop stalagmite from the belt. Reversal of the access door operation may return belt 115 in a second direction to about its former position.

Figure 3:
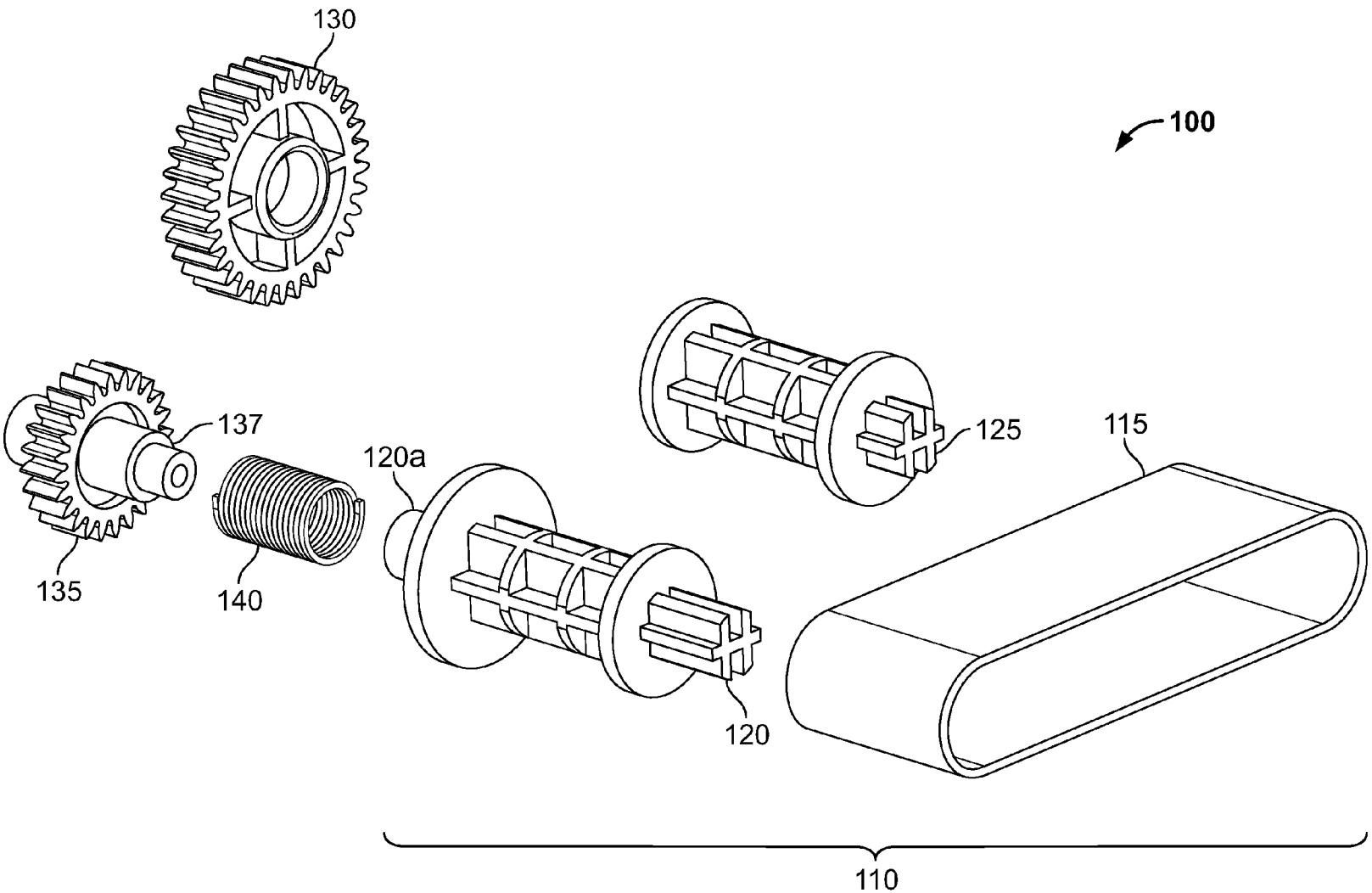
FIG. 3 illustrates an exploded view of the embodiment of FIG. 1.

FIG. 3 is an exploded view of the gears, rollers, slip clutch, and belt of clearing device 100. With reference to FIG. 3, receiving gear 135 may include shaft 137 that may have a reduced diameter portion that can be received by end 120*a* of drive roller 120. Slip clutch 140 may be coaxially located, and may be formed by a coil spring that may surround both shaft 137 and end 120*a*. When receiving gear 135 is rotated in a first direction, the coil spring may tighten and exert a retention force about shaft 137 and drive roller end 120*a*. The grip from the retention force may allow for motion of the coupled ends of shaft 137 and drive roller end 120*a*. Accordingly, drive roller 120 can rotate. When the rotation of receiving gear 135 is reversed, the coil spring may loosen the retention force and the drive roller 120 may be unable to rotate in unison with shaft 137. Other implementations of a slip clutch may be used—for instance, a ratchet or a one-way dog clutch design.

Referring again to FIG. 2, shaft 145 may be inserted through yoke 160 prior to drive gear 130 being pressed onto shaft end 145*a*. A housing 150 that may be formed integral to chimney plate 152 and spit chimney 155 may form a journal that may retain in place receiving gear 135, slip clutch 140 and the proximal end of drive roller 120. Receptacles (not shown) may retain the distal end of drive roller 120 and the ends of idle roller 125.

Figure 4A:
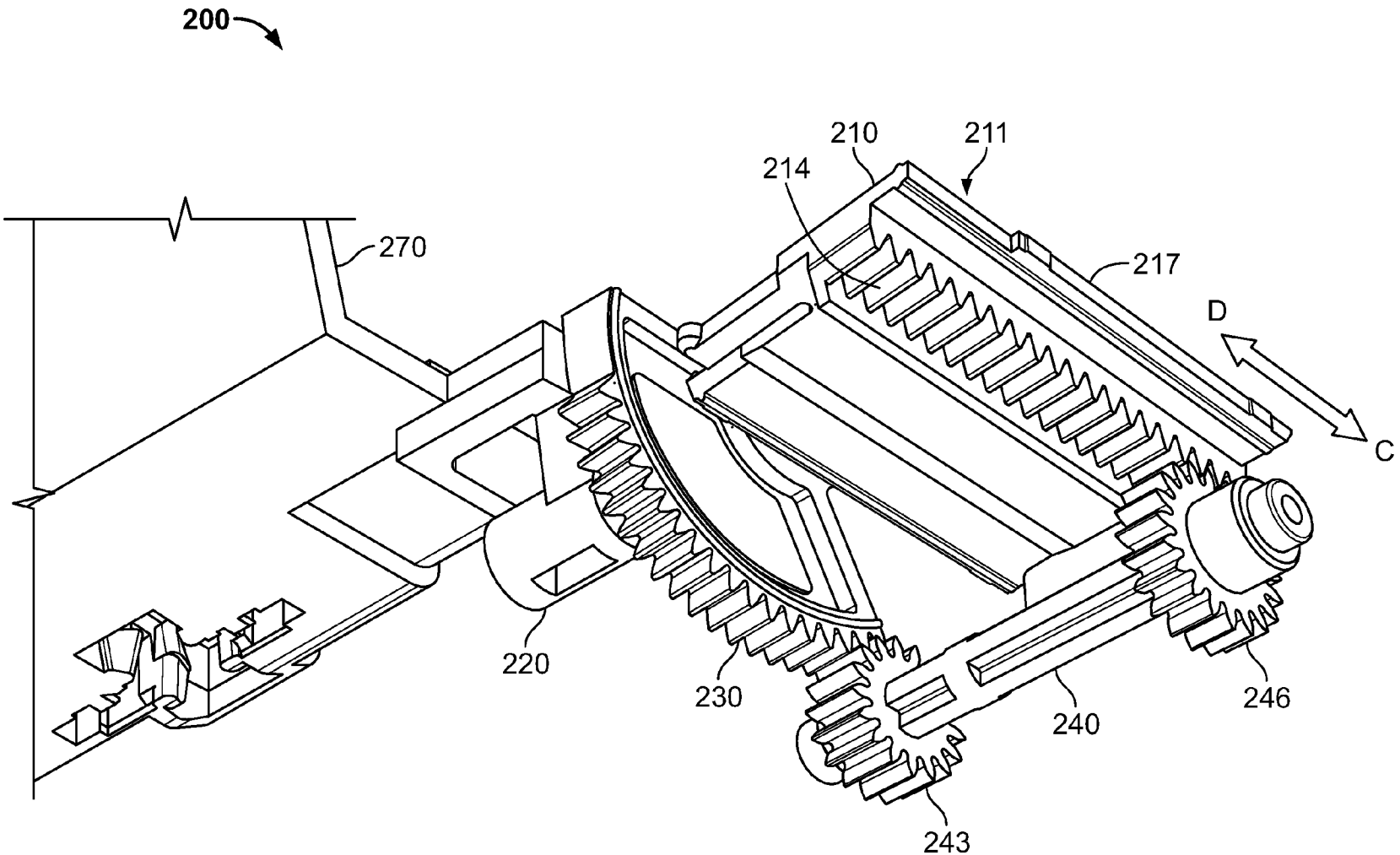
FIG. 4*a* illustrates a perspective view of another embodiment of the present invention in a retracted position.
Figure 4B:
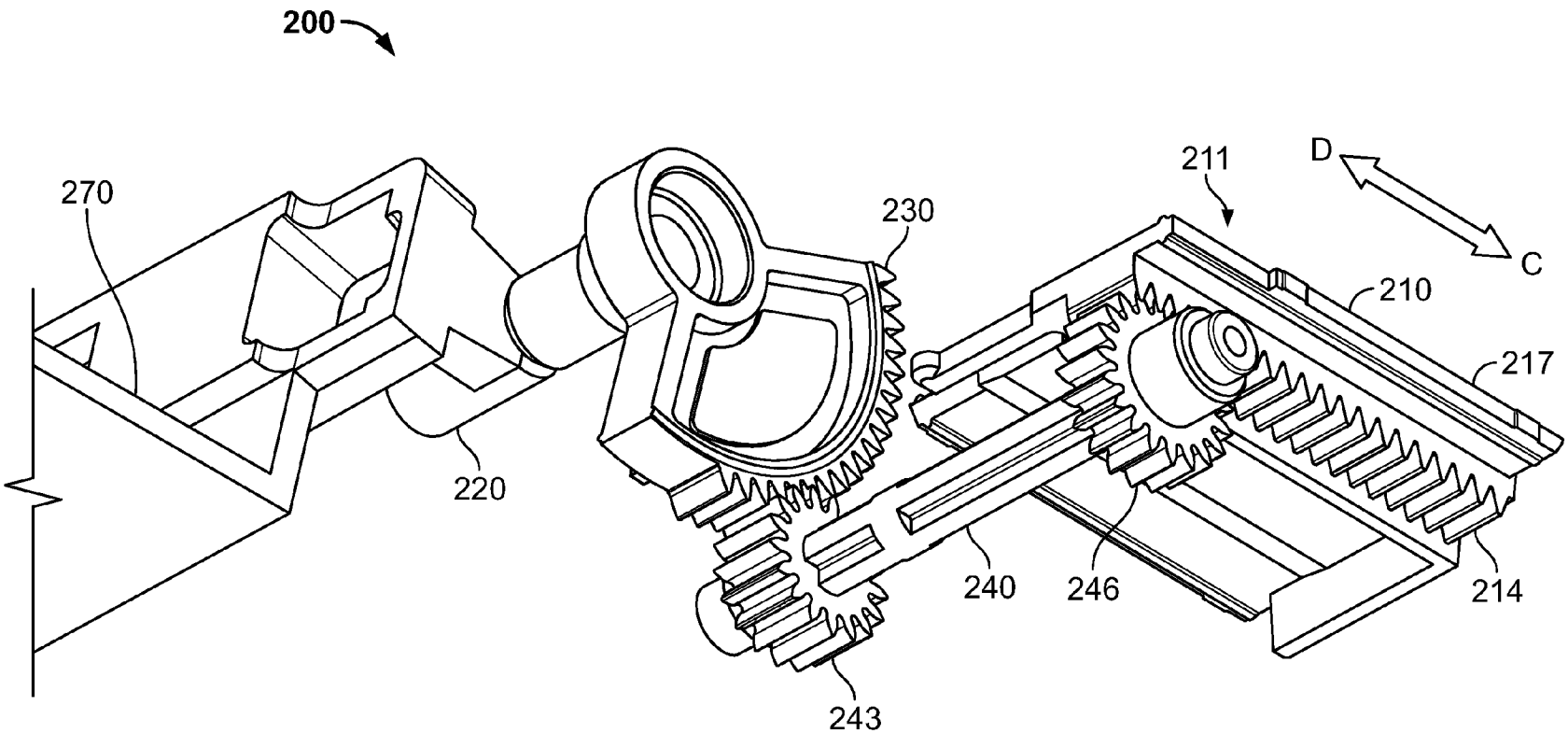
FIG. 4*b* illustrates a perspective view of the embodiment of FIG. 4*a* in an actuated position.
Figure 5A:
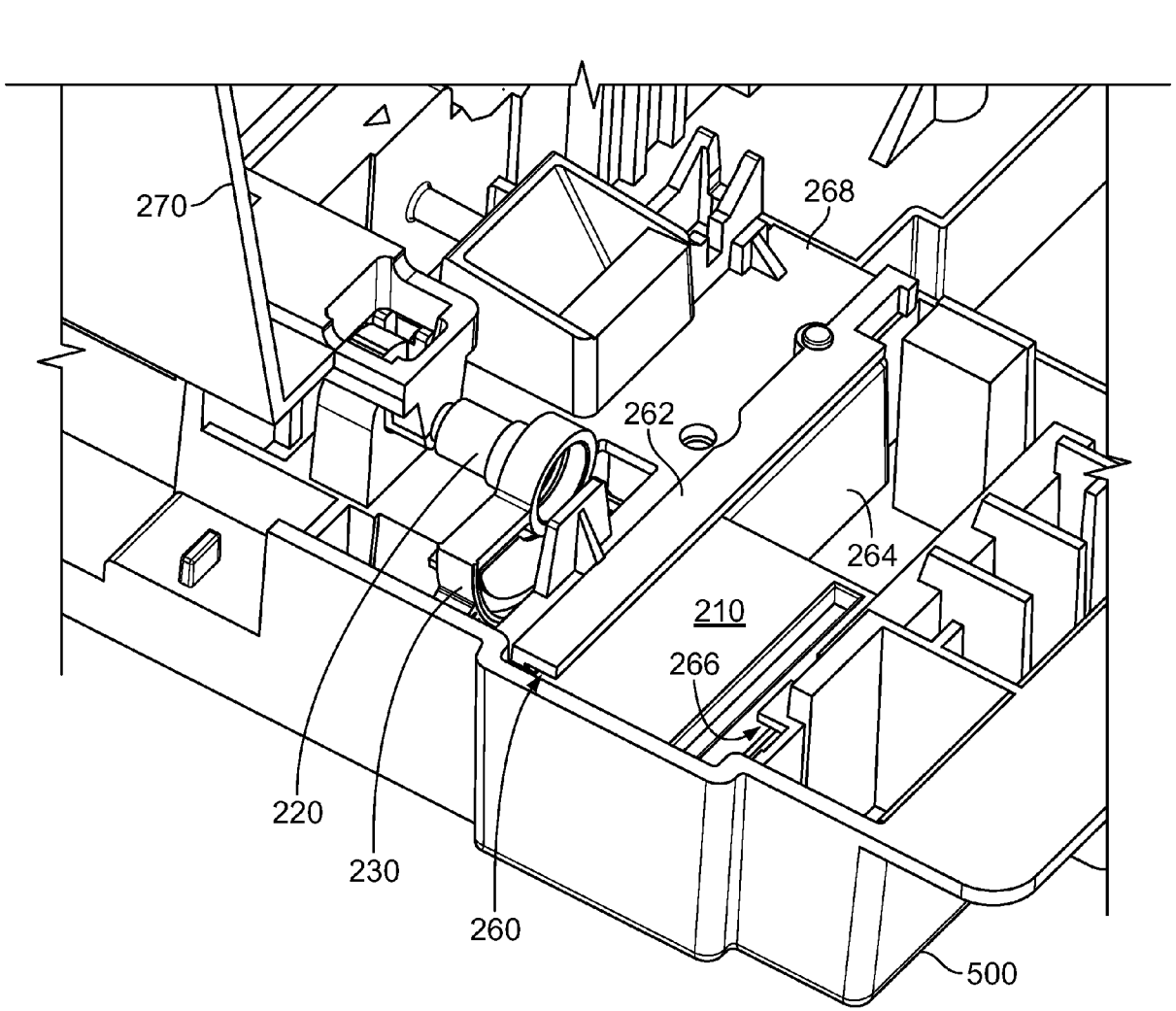
FIG. 5*a* illustrates a rear perspective view of the embodiment of FIG. 4*a* in a retracted position within a printer.
Figure 5B:
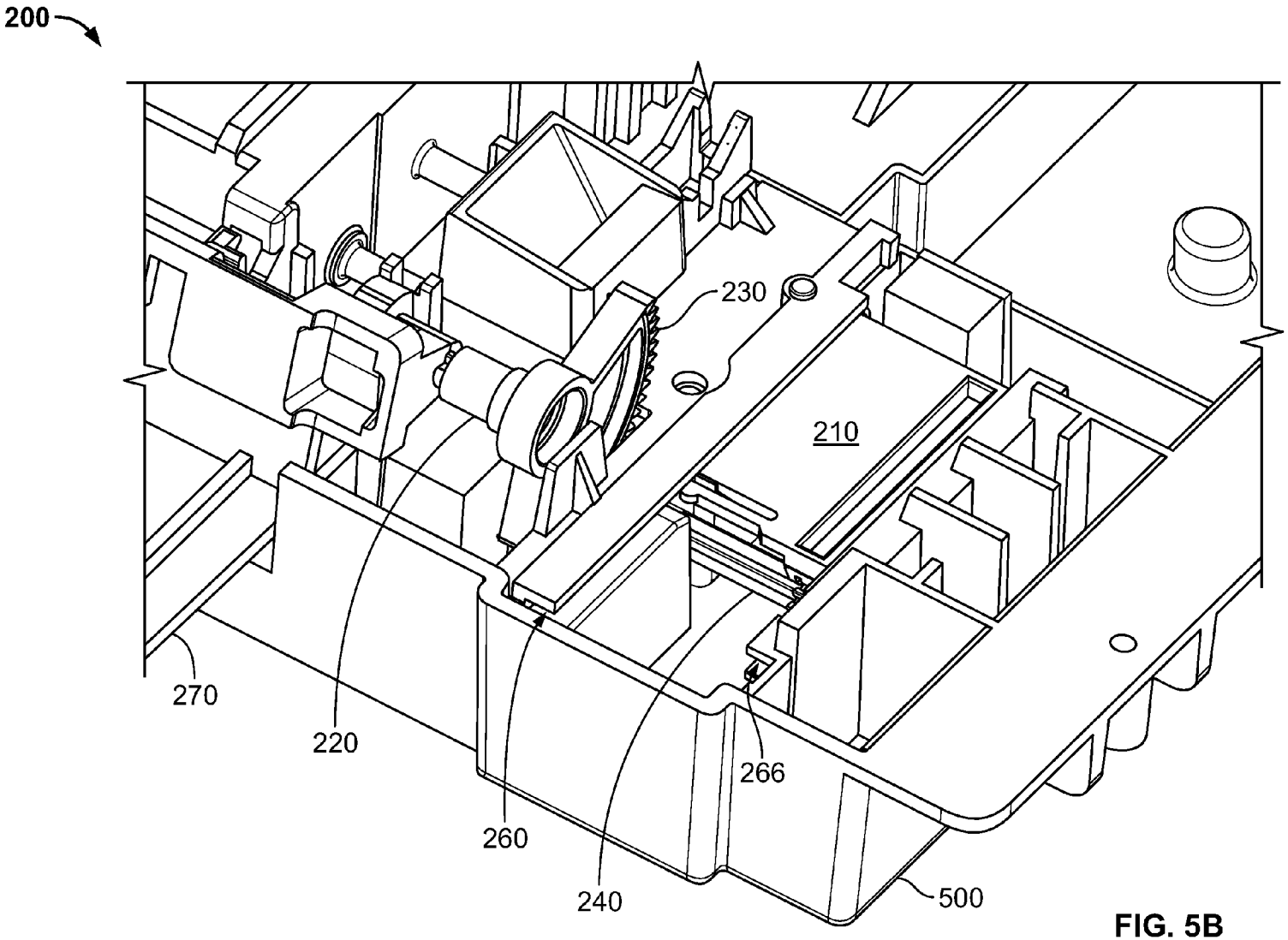
FIG. 5*b* illustrates a rear perspective view of the embodiment of FIG. 4*a* in an actuated position within a printer.
Figure 6:
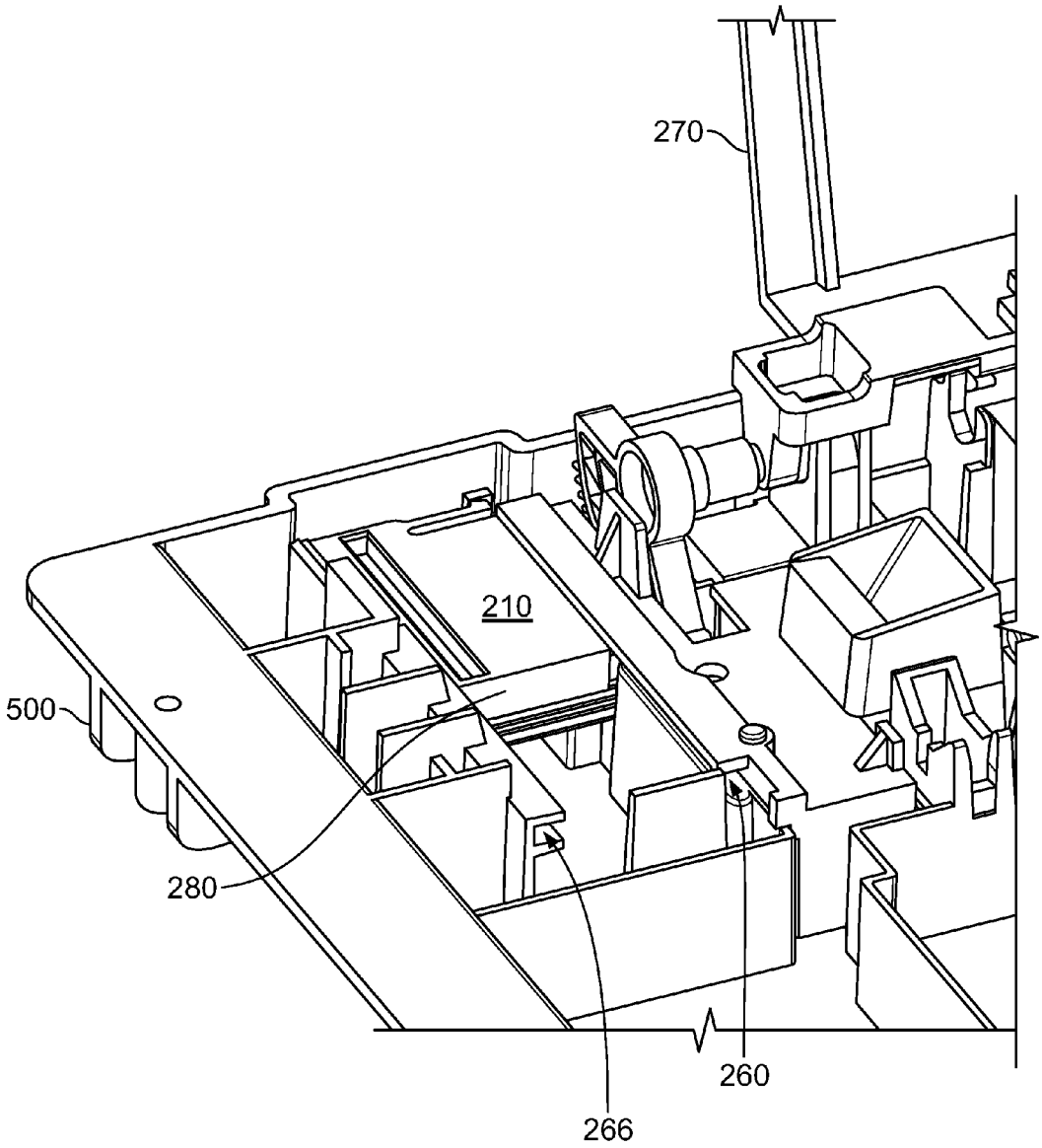
FIG. 6 illustrates a front perspective view of the embodiment of FIG. 4*a* in a retracted position within a printer.

FIGS. 4*a*, 5*a* and 6 depict clearing device 200, an embodiment of the present invention, in a retracted position. FIGS. 4*b* and 5*b* depict clearing device 200 in an actuated position. With reference to FIGS. 4*a* and 4*b*, clearing device 200 may include clearing mechanism 211 that may include rack-driven sled 210. Rack-driven sled 210 may be driven by a rack and pinion gear system (214, 230, 240, 243, and 246). Clearing device 200 may be driven by the operation of access door 270. Drive gear 230 may be rotationally coupled by shaft 220 to the access door hinge. Drive gear 230 may be a sector gear of about 90°. However, other gear configurations up to and including full 360° toothed gears may be used.

Operation of access door 270 may cause drive gear 230 to rotate. The teeth of drive gear 230 may be meshed with proximal gear 243 mounted on drive shaft 240. Distal gear 246 on drive shaft 240 may be coupled with rack gear 214 located on rack-driven sled 210. Operation of access door 270 may result in rack-driven sled 210 being driven by the rack and pinion gear system in a direction along arrow C (FIGS. 4*a*, 4*b*) to an actuated position.

Rack-driven sled 210 may have tabs 217 along two opposing sides. Referring also to FIGS. 5*a* and 5*b*, which are rear perspective views of clearing device 200 in a printer base, tabs 217 may be captivated by tracks 260, 266. As rack gear 214 is driven by distal gear 246, rack-driven sled 210 may travel suspended by tabs 217 in tracks 260, 266. Distal track 266 may be formed in the printer base 500 when the base is molded. Proximal track 260 may have a lower rail 264 that may also be formed when the printer base 500 is molded. Top rail 262 of proximal track 260 may be an extension of spit chimney plate 268. Mounting spit chimney plate 268 to the printer base may complete the formation of proximal track 260.

As depicted in FIG. 6, which is a front perspective view of clearing device 200 in a printer base, rack-driven sled 210 may include an ink drop stalagmite reducing face 280 located on the forward portion of the sled. Rack-driven sled 210 may move in a forward direction from its retracted position (FIGS. 4*a*, 5*a*) to its extended position (FIGS. 4*b*, 5*b*). When moved in the forward direction, stalagmite reducing face 280 may impact an ink drop stalagmite that has built up in the service station area. The ink drop stalagmite's height may be reduced below the bottom surface of rack-driven sled 210 by the impact. That portion of the ink drop stalagmite that may be impacted by stalagmite reducing face 280 may be forced down and forward into the printer base 500. The height of the ink drop stalagmite may be reduced sufficiently to prevent the ink drop stalagmite from growing tall enough to come in contact with the print head.

Reversing the operation of access door 270 may cause the rack and pinion gear system to drive rack-driven sled 210 in a direction indicated by arrow D (FIGS. 4*a*, 4*b*). The gearing ratio among the gears 214, 230, 243, and 246 may be correlated to the range of motion of access door 270 so that the travel of rack-driven sled 210 may extend at least far enough to impact the ink drop stalagmite growing in the service station area, and to retract the sled in the opposite direction.

As described above, gears 214, 230, 243, and 246 and drive shaft 240 may work in conjunction to form a power transfer device that may transfer the power from operating access door 270 into a lateral force substantially perpendicular to the axis of rotation. This lateral force may extend and retract clearing mechanism 211 including rack-driven sled 210 along tracks 260, 266. The lateral force can also be non-perpendicular, or even parallel, to the axis of rotation with the addition of one or more intermediate gears and/or linkage(s).

Figure 7:
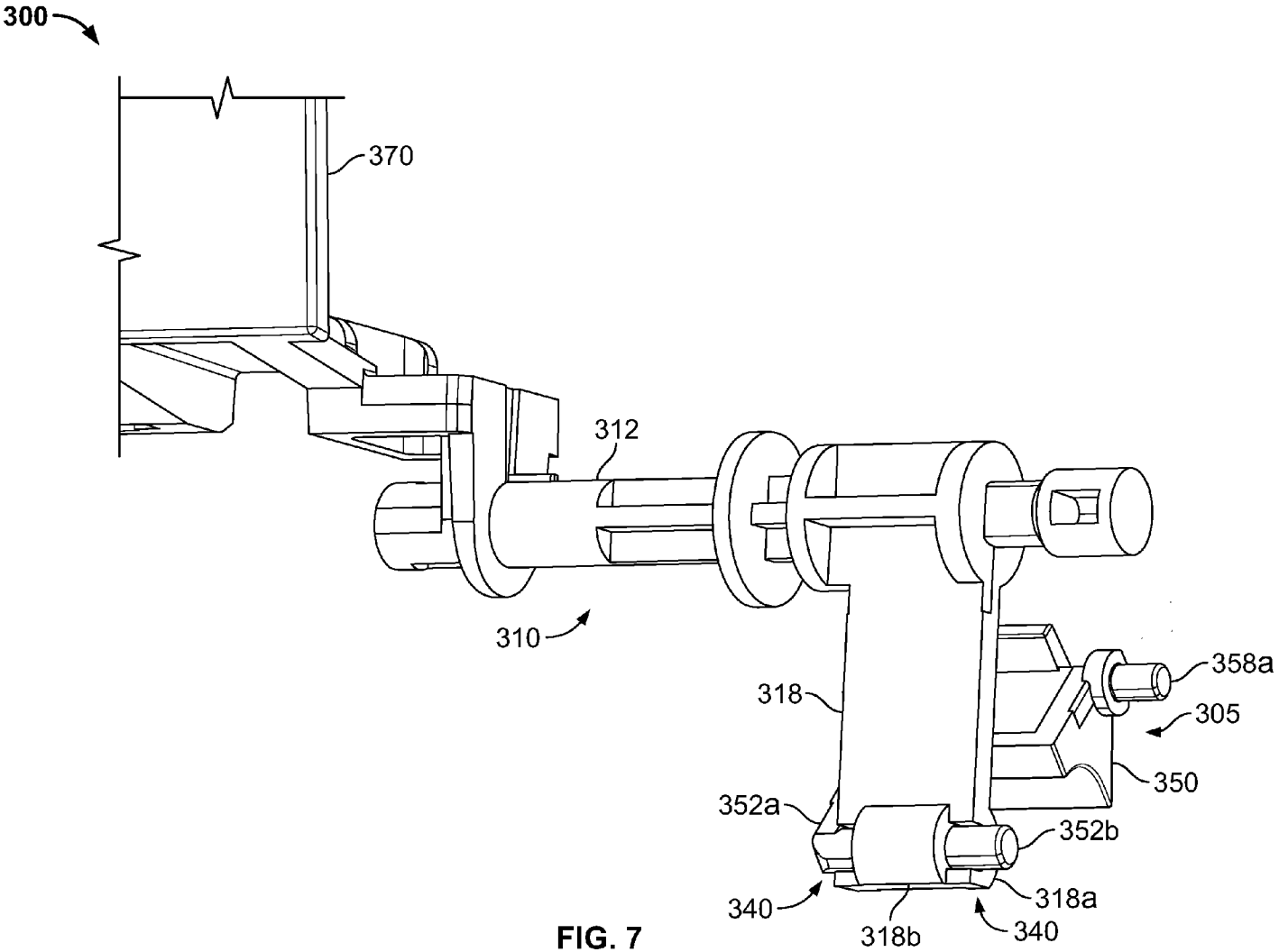
FIG. 7 illustrates a perspective view of another embodiment of the invention.
Figure 8A:
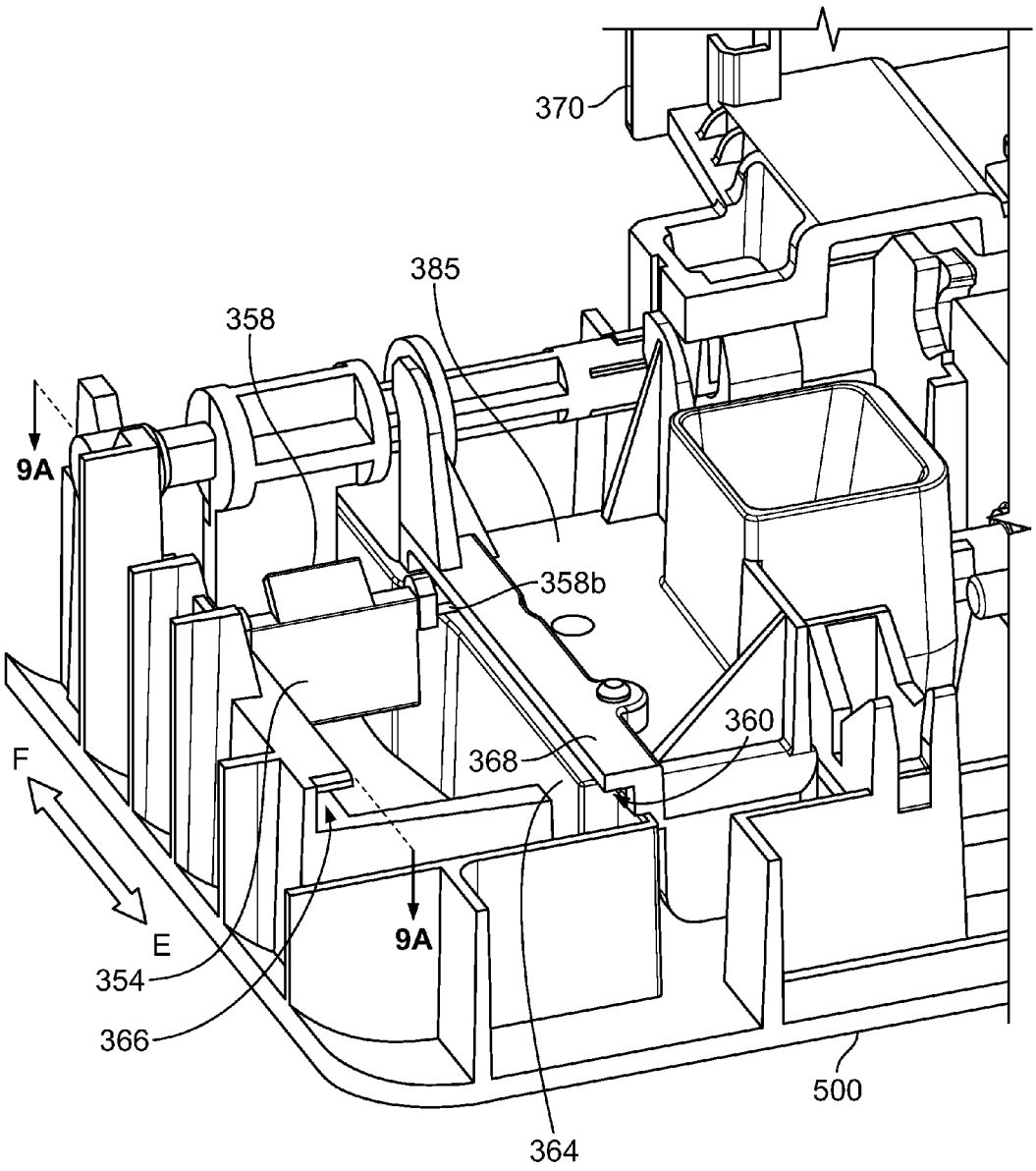
FIG. 8*a* illustrates a front perspective view of the embodiment of FIG. 7 in a retracted position within a printer.
Figure 8B:
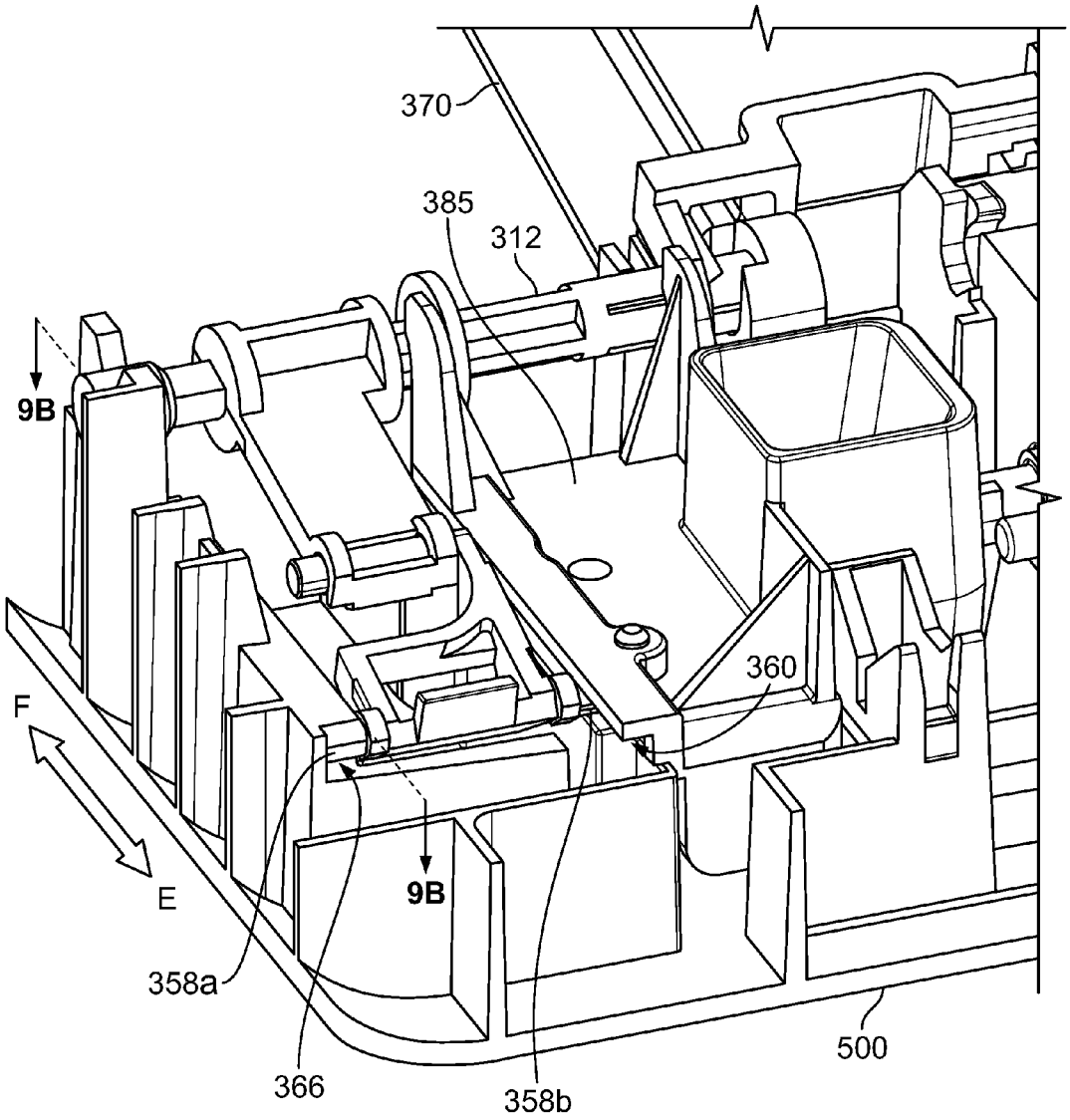
FIG. 8*b* illustrates a front perspective view of the embodiment of FIG. 7 in an actuated position within a printer.
Figure 9A:
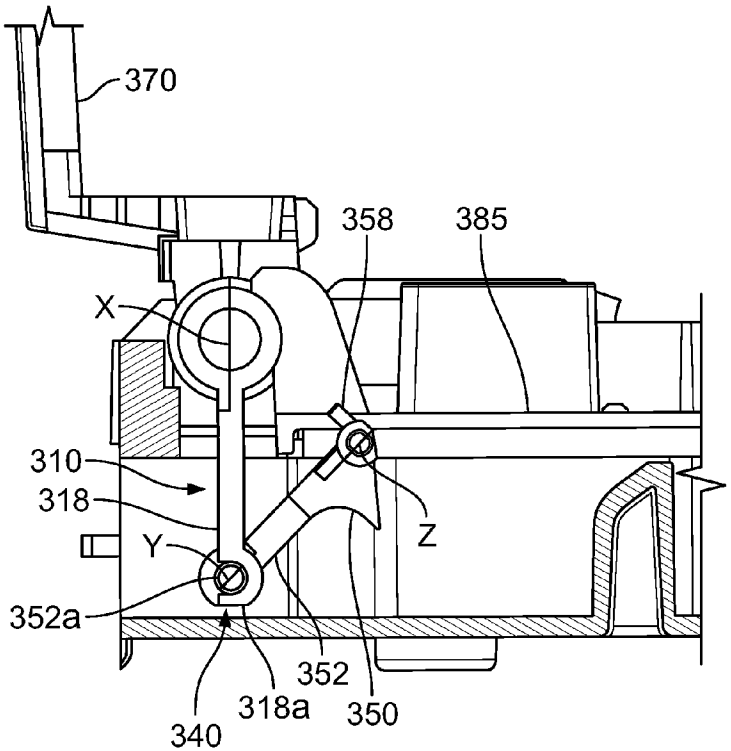
FIG. 9*a* illustrates a cross-sectional view taken along line 9*a*-9*a* of FIG. 8*a*.
Figure 9B:
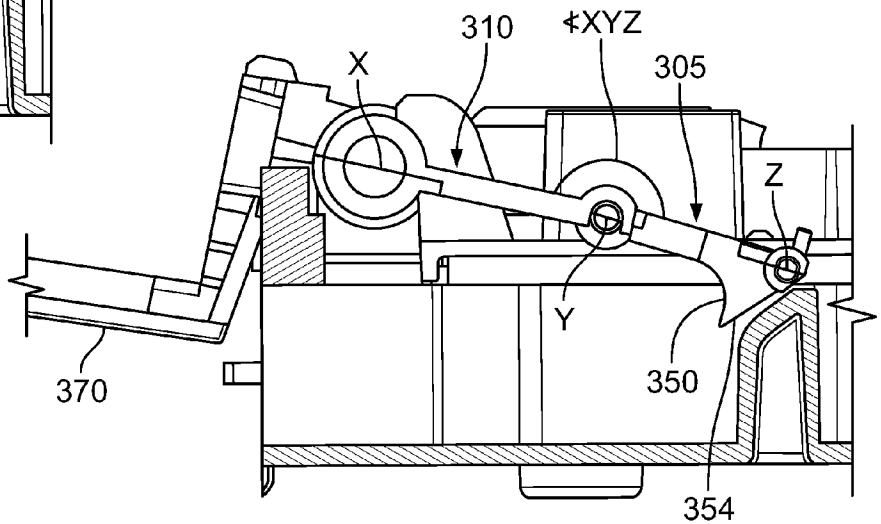
FIG. 9*b* illustrates a cross-sectional view taken along line 9*b*-9*b* of FIG. 8*b*.

FIGS. 7, 8*a* and 9*a* depict clearing device 300, an embodiment of the present invention, in a retracted position. FIGS. 8*b* and 9*b* depict clearing device 300 in an actuated position. With reference to FIG. 7, which also depicts access door 370, clearing device 300 may include swing arm 310 and clearing mechanism 305 that may include arm-driven sled 350 and sled arm 352. Swing arm 310 may be rotatably connected to access door 370 by shaft 312. Arm-driven sled 350 may include slide protrusions 358*a*, 358*b* on opposite sides of the sled. The slide protrusions may be engaged by tracks 360, 366 (FIGS. 8*a*, 8*b*).

Operating access door 370 may cause swing arm 310 to rotate, which may result in clearing mechanism 305 including arm-driven sled 350 being driven along a linear direction indicated by arrow E (FIGS. 8*a*, 8*b*) from a retracted position to an actuated position. Reversing the operation of the access door may cause clearing mechanism 305 including arm-driven sled 350 to retract in the direction of arrow F (FIGS. 8*a*, 8*b*) towards its former position.

Swing arm 310 may include shaft 312 and arm extension 318. Shaft 312 and arm extension 318 may be made from an integral piece of suitable, lightweight material such as plastic, resin, etc. At the distal end of arm extension 318 may be a freely-rotating hinge 340. Hinge 340 may be formed from complementary hinge portions 318*a*, 318*b* on arm extension 318. On proximal end 352*a* of sled arm 352 (see FIG. 9*a*) may be formed hinge pin 352*b*. Insertion of hinge pin 352*b* through complementary hinge portions 318*a*, 318*b* may complete the freely-rotating hinge 340. Arm extension 318 may be of a length great enough to increase the moment of the rotation force of shaft 312 to a sufficient power to drive clearing mechanism 305 including arm-driven sled 350.

Clearing device 300 does not typically add any substantial load to access door 370 to interfere with the access door's operation. In fact, it has been found that the drop-weight of the access door may be sufficient to generate enough of a moment to extend clearing mechanism 305. Further, in one example, rotating access door 370 by about 70° or greater may allow clearing mechanism 305 to extend sufficiently to impact an ink drop stalagmite, although lesser amounts of rotation may be enough to extend clearing mechanism 305 to sufficiently impact an ink drop stalagmite.

With reference to FIGS. 9*a*, 9*b*, which are cross-sectional views of clearing device 300, different selections of the length of arm extension 318 (segment XY) and the length of sled arm 352 (segment YZ) can result in different travel distances for clearing mechanism 305 including sled 310. As clearing mechanism 305 may extend from its retracted position, angle XYZ formed by swing arm 310 and clearing mechanism 305 may go from an acute angle (see FIG. 9*a*) to substantially a straight line XYZ (see FIG. 9*b*) to over-rotation (where angle XYZ is greater than 180°). Note that over-rotation of the clearing mechanism is not a problem because it does not result in over-travel of arm-driven sled 350 and does not cause clearing mechanism 305 to jam, because the rotational force from operating access door 370 is applied at point X. Thus, clearing mechanism 305 may retract when the rotation of hinge 340 is reversed.

With reference to FIGS. 8*a*, 8*b*, slide protrusions 358*a*, 358*b* may be engaged by tracks 360, 366. Distal track 366 may be formed in printer base 500 when the base is molded. Proximal track 360 may have a lower rail 364 that may also be formed when the printer base 500 is molded. Top rail 368 may be an extension of the spit chimney plate 385. Mounting the spit chimney plate to the printer base may complete the formation of proximal track 360.

Arm-driven sled 350 may include a stalagmite reducing face 354 located on the forward portion of the sled. As clearing mechanism 305 including arm-driven sled 350 may move from its retracted position (FIGS. 7, 8*a* and 9*a*) to its extended position (FIGS. 8*b*, 9*b*), stalagmite reducing face 354 may impact an ink drop stalagmite that has built up in the service station area. The ink drop stalagmite's height may be reduced below the bottom surface of arm-driven sled 350 by the impact. That portion of the ink drop stalagmite that is impacted by stalagmite reducing face 354 may be forced down and forward into printer base 500. The stalagmite reducing face 354 may include a protrusion 358 that may act to block the residue of the impacted ink drop stalagmite from traveling up and over the stalagmite reducing face and undesirably contaminating certain internal portions of the printer. The height of the ink drop stalagmite may be reduced sufficiently to prevent the ink drop stalagmite from growing tall enough to come in contact with the print head.

Arm extension 318 and sled arm 352 may work in conjunction as a two-bar linkage assembly to form a power transfer device that may transfer the rotational power from operating access door 370 into a lateral force substantially perpendicular to the axis of rotation. This lateral force may extend and retract clearing mechanism 305 including arm-driven sled 350 along tracks 360, 366. The lateral force can also be non-perpendicular, or even parallel, to the axis of rotation with the addition of one or more intermediate gears and/or linkage(s).

Clearing devices described herein have the benefit of not using drive power from the printer's motor(s) (e.g., carriage motor or paper drive motor) and/or existing mechanical linkages that may provide power to other moving parts of the printer. Additionally, the disclosed clearing devices do not rely on timing instructions from the printer's processor to synchronize their movement with the build-up of the ink drop stalagmite formed from expelling ink from a print head. Rather, the clearing devices use simple mechanical parts that may be driven by the operation of the printer's access door, without the need for sophisticated components, software instructions, and processor overhead.

While there have been shown and described fundamental novel features of the invention as applied to several embodiments, it will be understood that various omissions, substitutions, and changes in the form, detail, and operation of the illustrated embodiments may be made by those skilled in the art without departing from the spirit and scope of the invention. Substitutions of elements from one embodiment to another are also fully intended and contemplated. The invention is defined solely with regard to the claims appended hereto, and equivalents of the recitations therein.

We claim:

1. An apparatus for use with an inkjet printer, the apparatus comprising:

a clearing device coupled to an access door of the inkjet printer;

wherein the clearing device is configured, upon operation of the access door, to at least partially clear an ink drop stalagmite within the inkjet printer.

2. The apparatus of claim 1, wherein the clearing device comprises:

a power transfer device; and a clearing mechanism, wherein the power transfer device is configured to drive the clearing mechanism from a first position to a second position.

3. The apparatus of claim 2, wherein the power transfer device includes one of a power gear linkage system and drive roller, a rack and pinion gear system, and a two-bar linkage assembly.

4. The apparatus of claim 2, wherein the clearing mechanism includes one of a belt, a rack-driven sled, and an arm-driven sled.

5. An apparatus for use with an inkjet printer, the apparatus comprising:

a clearing device having a power transfer device and a clearing mechanism, the power transfer device coupled to an access door of the inkjet printer, the power transfer device configured to transfer operation of the access door into a lateral force, the clearing mechanism coupled to the power transfer device and configured to move in a first direction from the lateral force, wherein movement of the clearing mechanism in the first direction displaces an ink drop stalagmite within the inkjet printer in at least one of height and position.

6. The apparatus of claim 5, wherein the clearing mechanism is configured to move in a second direction when the operation of the access door is reversed.

7. The apparatus of claim 5, wherein the clearing device includes:

a drive gear coupled to the access door;

a first gear and a second gear coupled together, the drive gear coupled to the first gear; and a rack-driven sled assembly having a rack gear coupled to the second gear, and a forward end forming a stalagmite reducing face, wherein operation of the access door is configured to transfer power to move the rack-driven sled assembly so that the stalagmite reducing face clears the ink drop stalagmite by reducing its height.

8. The apparatus of claim 5, wherein the clearing device includes:

a swing arm having an extension arm, the swing arm coupled to the access door; and an arm-driven sled assembly having a forward end forming a stalagmite reducing face, the arm-driven sled assembly coupled to the swing arm, wherein operation of the access door is configured to move the arm-driven sled assembly so that the stalagmite reducing face clears the ink drop stalagmite by reducing its height.

9. The apparatus of claim 5, wherein the clearing device includes:

a drive gear coupled to the access door;

a receiving gear engaged by the drive gear;

a drive roller;

a slip clutch coupling the receiving gear and the drive roller; and a belt in contact with the drive roller, wherein operation of the access door is configured to move the belt so as to clear an ink drop stalagmite formed on the belt away from a print head of the inkjet printer.

10. The apparatus of claim 9, wherein the clearing mechanism is configured to remain stationary when the operation of the access door is reversed.

11. An apparatus for use with an inkjet printer, the apparatus comprising:

a two-bar linkage clearing device including:

a swing arm having an extension arm, the swing arm coupled to an access door of the inkjet printer; and an arm-driven sled assembly having a sled arm and a forward end forming a stalagmite reducing face, the extension arm coupled to the sled arm.

12. The apparatus of claim 11, wherein operation of the access door is configured to move the arm-driven sled assembly to an actuated position so that the stalagmite reducing face clears an ink drop stalagmite within the inkjet printer by reducing a height of the ink drop stalagmite.

13. The apparatus of claim 12, wherein the arm-driven sled assembly is configured to return to a retracted position when the operation of the access door is reversed.

14. The apparatus of claim 11, further including a protrusion located on the upper surface of the stalagmite reducing face.

15. The apparatus of claim 14, wherein the protrusion is configured to block residue from the ink drop stalagmite so as to prevent contamination of internal portions of the inkjet printer.

16. The apparatus of claim 11, further including:

slide protrusions on longitudinal opposing sides of the sled assembly, wherein the slide protrusions engage tracks within the inkjet printer.

17. The apparatus of claim 16, wherein the inkjet printer has a base, the tracks including:

a distal track formed in the base; and a proximal track having a lower portion formed in the base and an upper portion formed from a mounting plate attached to the base.

18. The apparatus of claim 11, further including:

a hinge;

a distal portion of the swing arm having complementary portions of the hinge; and a proximal portion of the sled arm having a hinge pin, wherein the hinge pin resides within the complementary hinge portions so as to couple the extension arm and sled arm.

19. The apparatus of claim 11, wherein the two-bar linkage clearing device is configured to return to a retracted position when the access door is operated in a second direction if an over-rotation occurs when the access door is operated in a first direction.

20. The apparatus of claim 11, wherein rotation of the access door by an angle of at least about 70° allows sufficient extension of the arm-driven sled assembly.

* * * * *